US005362032A

United States Patent [19]

Ranki

[11] Patent Number: 5,362,032

[45] Date of Patent: Nov. 8, 1994

[54] APPARATUS FOR FEEDING GASES INTO A SMELTING FURNACE

[75] Inventor: Markus K. T. Ranki, Espoo, Finland

[73] Assignee: Outokumpu Engineering Contractors OY, Espoo, Finland

[21] Appl. No.: 69,072

[22] Filed: May 28, 1993

[30] Foreign Application Priority Data

Jun. 1, 1992 [FI] Finland ..... 922530

[51] Int. Cl.[5] ..... C22B 5/12

[52] U.S. Cl. ..... 266/182; 75/707

[58] Field of Search ..... 266/182; 75/455, 639, 75/694, 707

[56] References Cited

U.S. PATENT DOCUMENTS 5,133,801 7/1992 Saarinen ..... 75/707

*Primary Examiner*—Melvyn J. Andrews

*Attorney, Agent, or Firm*—Brooks Haidt Haffner & Delahunty

[57] ABSTRACT

The present invention relates to a method and apparatus for feeding reaction gases, advantageously oxygen and air or a mixture thereof, into a smelting furnace so that the cross-sectional area wherethrough the reaction gases are fed can be adjusted. Thus the velocity of the gases when they are discharged into the smelting furnace can be maintained sufficiently high while the quantity and quality of the gas varies.

4 Claims, 1 Drawing Sheet

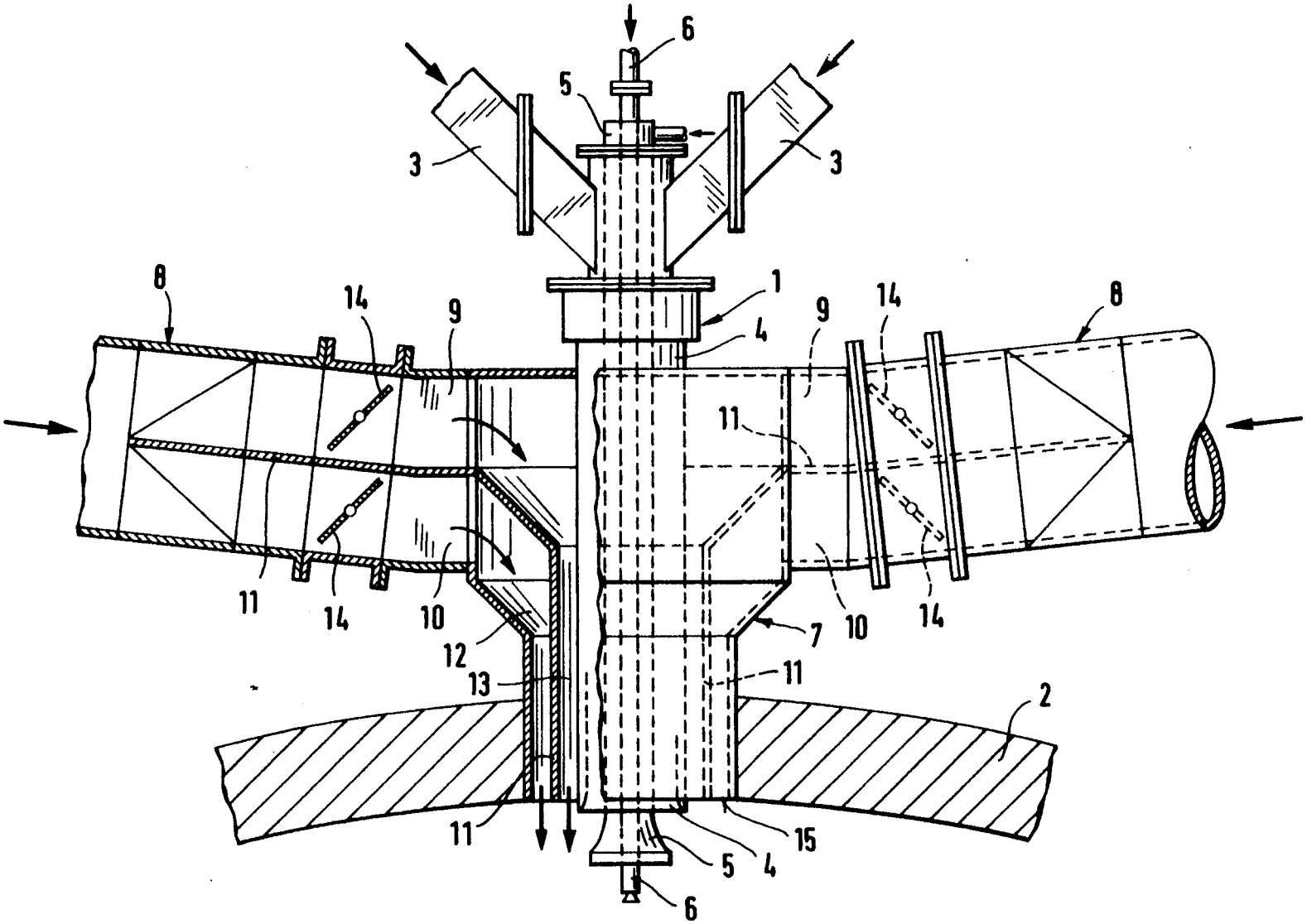
8
2
14
14
10
9
7
11
15
1
4
4
5
6
6
3
5
3
9
10
12
13
11
14
14
11
8

APPARATUS FOR FEEDING GASES INTO A SMELTING FURNACE

BACKGROUND OF THE INVENTION

The present invention relates to a method and apparatus for feeding reaction gases, advantageously oxygen and air or a mixture thereof, into a smelting furnace so that the cross-sectional area through which the gases are fed can be adjusted. Thus the velocity of the gases when they are discharged into the smelting furnace can be maintained sufficiently high with a varying quantity and quality of the gas.

When reaction agents and reaction gases are fed into a suspension smelting furnace, these are brought into contact with each other and mixed only in the reaction zone of the furnace. Now the mass transfer between the reacting solid particle and surrounding gas is rendered as high as possible in the reaction space itself, because the velocity difference between the reaction gas and the powdery solid matter also is made as great as possible.

From the U.S. Pat. No. 4,210,315 there is known an apparatus where the suspension of a powdery solid substance and a reaction gas is formed by feeding the solid substance into the reaction space centrally with respect to the reaction gas supply. Inside the solid substance feed pipe, there is coaxially installed a gas supply pipe wherethrough part of the gas is fed, and the bottom end the gas supply pipe is made conical so that gas is discharged through apertures provided at the bottom end of the cone. The gas emitted through the discharge apertures directs the solid substance falling along the conical surface towards the reaction gas zone proper, coming from outside the solid substance flow, i.e. towards the periphery of the reaction space.

From the U.S. Pat. No. 3,392,885 there is known a method and apparatus whereby the direction of the main reaction gas flow described in the above patent can be flexibly changed. By means of this apparatus, a horizontally supplied gas flow is divided to sub-flows radially with the aid of partition walls, and simultaneously the direction of the gas flow is turned to be parallel to the central axis of the reaction shaft of the smelting furnace, so that the velocity of the sub-flows increases at the same time. The sub-flows are discharged into the reaction space as an annular flow, thus encircling the concentrate flow supplied from the inside.

The U.S. Pat. No. 4,392,885 describes a method and apparatus whereby the major part of the reaction gas flow according to the U.S. Pat. No. 4,210,315 is fed symmetrically in several turbulent jets from around the pulverous substance flow into the reaction space. The discharge pipes, wherethrough the turbulent jets flow, are adjustable so that the degree and direction of turbulence therein can be adjusted.

The above described apparatuses designed for feeding pulverous substances, mainly concentrates, are perfectly usable as long as the amount of the material to be fed into the smelting furnace remains more or less the same. If the amount of concentrate to be fed into the smelting furnace is for some reason essentially reduced, the amount of supplied reaction gas must likewise be reduced. Generally there are no serious problems in feeding the concentrate; both measured and smaller amounts can normally be easily fed in through the same supply devices. However, a bigger problem arises with respect to the reaction gas to be supplied, for if the amount of gas is essentially reduced, its velocity in the discharge aperture also is reduced, because the transversal surface wherethrough it is fed still remains the same.

If the gas discharge velocity in the concentrate distributor and thus in the reaction zone of the furnace is essentially reduced, this causes difficulties in creating a good suspension in the reaction shaft, and as a consequence the reactions between concentrate and gas take place in an irregular and unsatisfactory manner. These difficulties are somewhat alleviated by means of the apparatus according to the U.S. Pat. No. 4,392,885, where the gas turbulence is intensified, but if the amount of gas falls for instance to half of the measured values, a good suspension is difficult to achieve even with this method. Another important reason for the diminishing of the reaction gas amount is that there is a growing tendency towards an intensified oxygen enriching, which naturally decreases the amount of employed gas.

According to the present invention, there is now developed a method and apparatus where the cross-sectional flow area, wherethrough the reaction gas flows, can be adjusted so that the flowing velocity of the reaction gases can be maintained sufficiently high, and thus a good suspension between the particles of the pulverous solid substance and the gas can be ensured in the reaction shaft of the furnace, in which case the desired reactions between the solid substance and the gas proceed rapidly.

Accordingly, the method of the invention for feeding reaction gases to the reaction shaft of a suspension smelting furnace is based on the fact that the gas distribution chamber is divided into several nested parts, so that gas can be fed in either through all annular sub-chambers, or only through one chamber, for example, depending on the amount of gas, and thus a sufficient gas velocity can be maintained all the time at the gas discharge aperture. Gas can be brought into the gas distribution chamber from one or several directions.

The pulverous material, such as concentrate, and fluxes may be fed centrally from inside the gas distribution chamber, by means of for instance the central jet distributor according to the U.S. Pat. No. 4,210,315 or the apparatus according to the U.S. Pat. No. 5,133,801. By means of the method of the invention, for example the air/oxygen ratio of the reaction gas can be adjusted steplessly, because the gas quantity is decreased while the oxygen ratio is increased, and this decreased amount of gas can now be fed in without using all sub-chambers.

BRIEF DESCRIPTION OF THE DRAWING

The apparatus of the invention is further described with reference to the appended drawing, which illustrates a preferred embodiment of the invention in partial cross-section seen from the side.

DETAILED DESCRIPTION OF A PREFERRED EMBODIMENT

The concentrate distributor 1 is installed in the arch 2 of a smelting furnace, such as a suspension smelting furnace, so that the pulverous solid substance, such as concentrate, and reaction gases discharged from the distributor are supplied through separate channels and meet only in the reaction shaft located underneath the arch to form a suspension there.

The concentrate is brought into the distributor through concentrate pipes 3, and is made to flow down the pouring pipe 4 to the reaction shaft. Inside the concentrate pouring pipe 4, there is arranged a supply pipe 5 for the gas, generally air, which is supplied in order to disperse the concentrate, and the bottom end of the supply pipe 5 extends lower than the bottom part of the pouring pipe 4 and is made conical and provided with perforations at the terminal edge. The dispersion air is discharged through the perforations nearly horizontally and thus disperses the concentrate curtain that flows around in an annular configuration, Inside the dispersing air supply pipe, there can also be arranged another gas supply pipe 6, wherethrough part of the required reaction gas is conducted into the reaction space. Advantageously this gas is oxygen.

The major part of the reaction gas is conducted via the gas distribution chamber 7 surrounding the concentrate pouring pipe 4, to which gas distribution chamber 7 the gas is conducted through at least one feed pipe 8. In the drawing there are two feed pipes. At its other end, prior to ending in the gas distribution chamber, the feed pipe is divided into at least two separate parts 9 and 10 by means of partition walls 11. The direction of the partition wall is turned to be parallel to the central axis of the reaction shaft, i.e. vertical, and it is formed to continue in an annular fashion inside the essentially cylindrical gas distribution chamber as far as the bottom end of the chamber. Thus the gas distribution chamber is formed of several nested annular members 12, 13, and the gas discharge aperture to the reaction shaft thus comprises two or more compartments.

The gas supply to the gas distribution chamber is fed by means of supply valves 14 provided in the feed pipes 8, which valves can be manually or automatically adjustable. Thus the process gas is conducted to each of the nested chambers 9, 10 through a separate channel provided with an adjusting valve. The partition walls 11 of the sub-chambers extend as far as the discharge edge 15 of the gas distribution chamber, i.e. as far as the bottom edge of the furnace arch. While running with maximum load, the gas is discharged from every nested chamber at a velocity which is most advantageous for the process in question. While running with minimum load, the required amount of process gas is conducted through one chamber only, while the rest are closed.

I claim:

1. Apparatus for feeding a pulverous material and gases into a suspension smelting furnace through an arch of the suspension smelting furnace and for permitting adjustment of the flow of gases to accommodate variation of the quantity and quality of the gases, comprising: a pouring pipe for feeding the pulverous material into the furnace; a generally annular gas distribution chamber surrounding the pouring pipe; an annular partition in the gas distribution chamber dividing the gas distribution chamber into nested, concentric, annular sub-chambers; means for feeding gases separately to each of said sub-chambers; means for adjusting the flow of gases to each sub-chamber; and means for discharging gases to the furnace from said sub-chambers.

2. Apparatus according to claim 1 and including a supply pipe for reaction gases within said pouring pipe.

3. Apparatus according to claim 1 including a gas feed pipe for delivering gas to the gas distribution chamber and wherein the means for feeding gases separately to each sub-chamber comprises a partition in said gas feed pipe extending to the annular partition in the gas distribution chamber to divide the gas feed pipe into separate channels.

4. Apparatus according to claim 3 and including supply valves in the separate channels.

* * * * *

UNITED STATES PATENT AND TRADEMARK OFFICE

CERTIFICATE OF CORRECTION

PATENT NO. : 5,362,032
DATED : November 8, 1994
INVENTOR(S) : Markus K. T. Ranki It is certified that error appears in the above-indentified patent and that said Letters Patent is hereby corrected as shown below:

The title should read
-- APPARATUS FOR FEEDING REACTION GASES
INTO A SMELTING FURNACE --.

Column 3, line 12 "configuration, Inside" should read
-- configuration. Inside --.

Signed and Sealed this

Seventh Day of February, 1995

*Attest:*

*Attesting Officer*

BRUCE LEHMAN

*Commissioner of Patents and Trademarks*